United States Patent [19]

Mathes

[11] Patent Number: 4,796,529

[45] Date of Patent: Jan. 10, 1989

[54] SHEET TURNING DEVICE FOR ROTARY PRESSES OF THE IN-LINE TYPE

[75] Inventor: Josef Mathes, Offenbach am Main, Fed. Rep. of Germany

[73] Assignee: M.A.N.-Roland Druckmaschinen Aktiengesellschaft, Offenbach am Main, Fed. Rep. of Germany

[21] Appl. No.: 937,550

[22] Filed: Dec. 3, 1986

[30] Foreign Application Priority Data

Dec. 3, 1985 [DE] Fed. Rep. of Germany ..... 3542649

[51] Int. Cl.[4] ..... B41F 21/10; B41F 13/18

[52] U.S. Cl. ..... 101/230; 101/246

[58] Field of Search ..... 101/230, 231, 246, 409, 101/410–412, 418, 407 R, 407 A; 271/276, 186, 902

[56] References Cited

U.S. PATENT DOCUMENTS 1,072,703 9/1913 Cottrell ..... 101/418

4,018,161 4/1977 Johne et al. ..... 101/230

*Primary Examiner*—J. Reed Fisher

*Attorney, Agent, or Firm*—Leydig, Voit & Mayer

[57] ABSTRACT

The invention relates to a sheet turning device for rotary presses of the in-line type with double-size impression cylinders associated with a single double-size transfer or turn-over drum. To enable the sheet end to be gripped by gripper devices, the impression cylinder preceding the turn-over drum is provided with an adjustable covering, preferably a roller blind with a foil covering thereabove, to give the impression cylinder its actual diameter.

18 Claims, 9 Drawing Sheets

SHEET TURNING DEVICE FOR ROTARY PRESSES OF THE IN-LINE TYPE

FIELD OF THE INVENTION

This invention relates to rotary presses of the in-line type, and more particularly to sheet turning devices used in rotary presses.

BACKGROUND OF THE INVENTION

Sheet turning devices in rotary presses give rise to considerable problems in view of the printing speeds that are conventional today, particularly in the processing of cardboard, although the same problems apply to the processing of smooth and thin papers. Specifically, the sheet end must be removed in taut form from the closed surface of the impression cylinder by means of suckers and conveyed in register while being subjected to high tensile and/or tilting forces. Because of the limited retaining power, suckers are unreliable and therefore relatively unsuitable. Another disadvantage of suckers is that they require considerable aerodynamic engineering work.

OBJECTS AND SUMMARY OF THE INVENTION

The primary object of the invention is to enable gripper devices in a sheet turning devices to provide true-register transfer of sheets from the loading impression cylinder for printing supports of any thickness and length and up to the maximum printing speeds.

A related object of the invention is to increase registration reliability of mechanical gripper transfers that are used generally both for single-sided printing and for perfecting.

In summary, a sheet turning device for rotary presses of the in-line type is disclosed that includes a double-size impression cylinder having an adjustable covering which enables the end of a sheet to be gripped by the gripper system of an adjacent turn-over drum. The adjustable cover is adapted to be wound about a shaft mounted in the impression cylinder so that the circumferential length of the cover may be adjusted to complement the length of a sheet. In addition, the cover includes adjustable suction cups to ensure the trailing edge of the sheet is kept taut.

These and other features and advantages of the invention will be more readily apparent upon reading the following description of a preferred exemplified embodiment of the invention and upon reference to the accompanying drawings.

While the invention will be more fully described and disclosed in connection with certain preferred embodiments and procedures, it is not intended to limit the invention to those specific embodiments.

DETAILED DESCRIPTION OF THE PREFERRED EMBODIMENT

Figure 1:
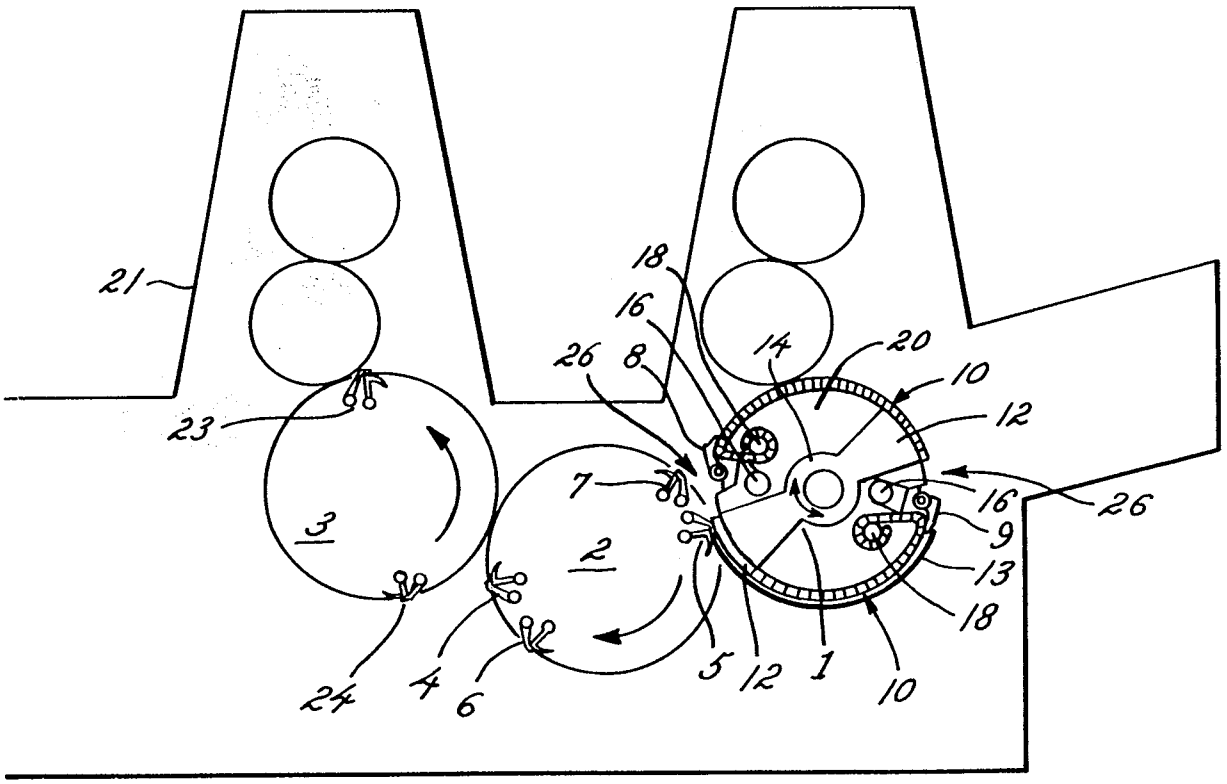
FIG. 1 is a diagrammatic side elevation of a sheet-fed offset rotary press for optional single-sided or double-sided printing, operating on the principle of turning the trailing edge of the sheet.
Figure 2:
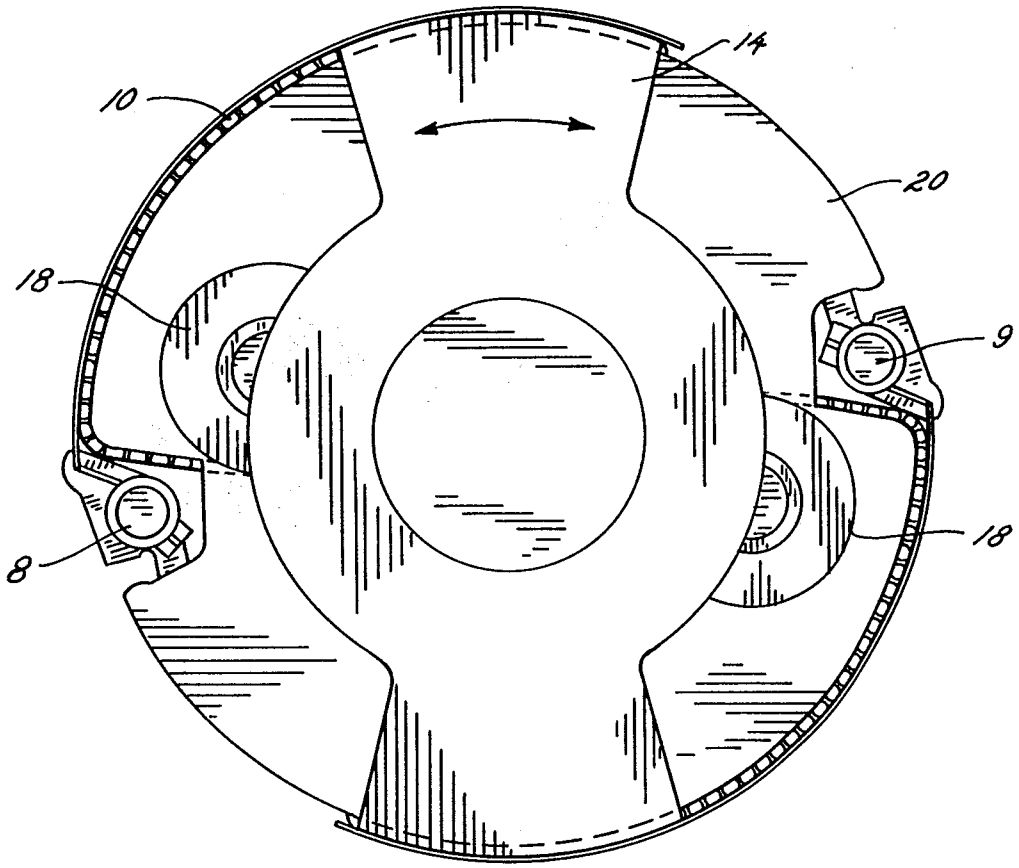
FIG. 2 is a side elevation of the impression cylinder preceding the turn-over drum.

Turning to the drawings and referring first to FIG. 1, a sheet-fed rotary press for optional perfecting is illustrated using the known principle of turning the trailing edge of the sheet. The two-color printing unit 21 shown diagrammatically in FIG. 1 comprises a double-size transfer drum or turnover drum 2 positioned between double-size impression cylinders 1 and 3 mounted in side columns 11 (FIG. 3) in known manner. The sheets 13 for printing are also fed to the impression cylinder 1 and taken off from the impression cylinder 3 in a known manner. The impression cylinders 1 and 3 are each provided with two gripper devices 8, 9 and 23, 24, respectively, which are disposed diametrically opposite one another and with appropriate control are used to transport the sheet 13.

The impression cylinders 1, 3 and transfer or turnover drum 2 are each adapted to transport two sheets 13 at the periphery. To enable mechanical gripper transfers to be carried out throughout, the double-size drum 2 comprises two pairs of gripper transfers consisting of cooperating gripper devices 4, 6 and 5, 7 which are pivotable relatively to one another. The gripper devices 4, 6 and 5, 7 are situated diametrically opposite one another in pairs.

Figure 9:
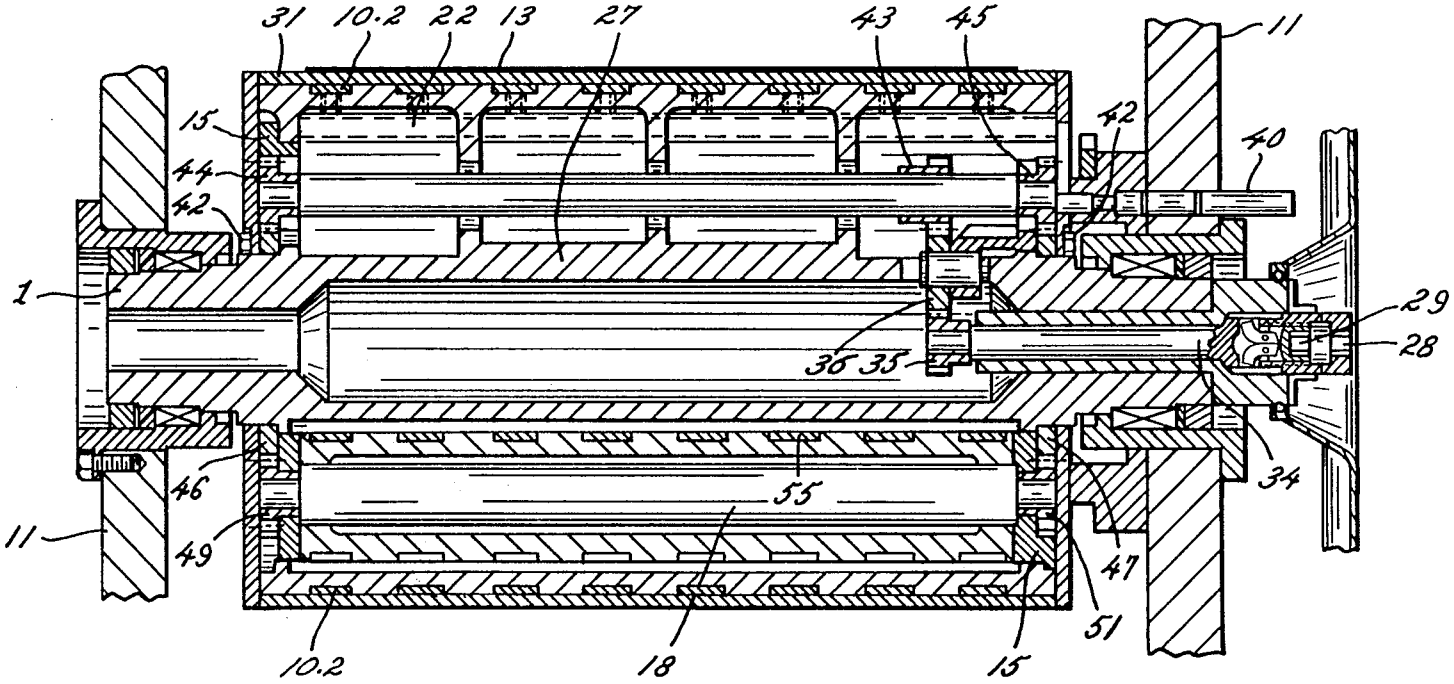
FIG. 9 is a longitudinal section through an impression cylinder in a partially different embodiment.
Figure 10:
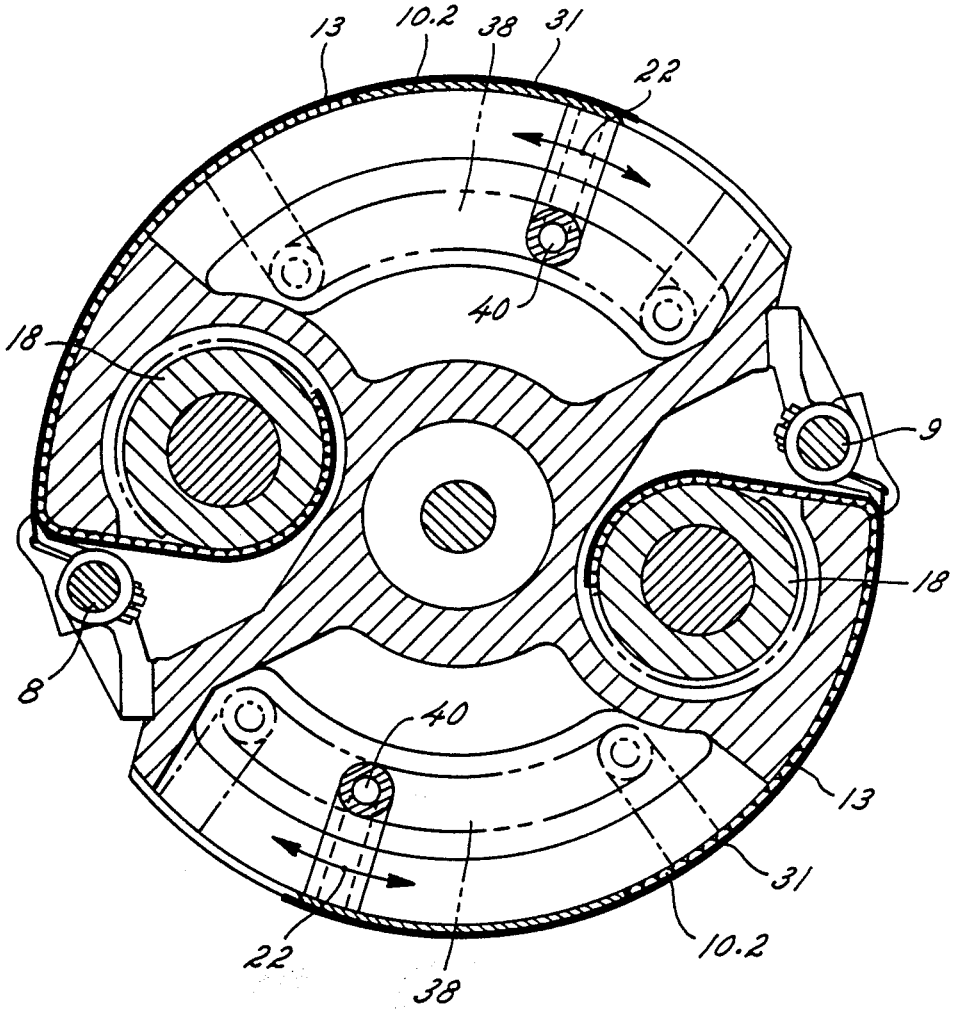
FIG. 10 is a cross-section through the impression cylinder shown in FIG. 9.

In accordance with one important aspect of the invention, to enable the front gripper devices 4 and 5 (as considered in the direction of rotation) to take off the trailing edge of the sheet at the tangent point, an adjustable covering 10 is provided on the impression cylinder 1 preceding the drum 2 so as to enable the sheet end to be gripped. For this purpose, referring to FIGS. 1 to 8, the impression cylinder comprises a barrel 20 which is several millimeters smaller and closed over the entire printing area, the covering 10 which rests thereon being in the form of a roller blind or sliding shutter 10.1 with a foil covering 17 thereabove, which gives the impression cylinder 1 its actual diameter. Alternatively, as shown in FIGS. 9 and 10, a plurality of roller blind strips 10.2 are circumferentially countersunk as a covering 10 in the impression cylinder 1. The surfaces of the strips 10.2 coincide with the impression cylinder surface and are covered by a continuous cover plate 31 which gives the impression cylinder 1 its actual diameter. The foil covering 17 above the roller blind 10.1 may, for example, be a foil which extends over the entire width of the impression cylinder 1 and which consists of fine steel, strip, corresponding fabric or the like of a thickness of 0.2 to 1 mm, while the continuous cover plate 31 may be 1 mm thick, for example, above the roller blind strips 10.2.

Figure 7:
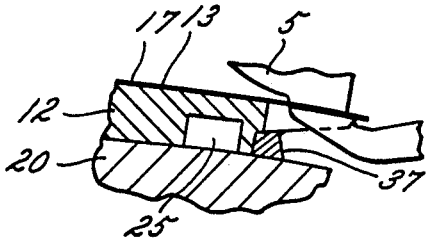
FIG. 7 is a cross-section of another detail.

The impression cylinder 1 preferably has an outside diameter which is at least 3 mm smaller so that the gripper devices 4 and 5 can engage beneath the sheet 13 at the end thereof when the roller blind 10.1 is used (FIG. 7). This smaller diameter results in the creation of variable clearances 26 in FIG. 1 between the gripper devices 5, 8 and 4, 9 for engagement of the trailing edge of the sheet, so that on each adjustment of the format the front gripper devices 4 and 5 (as considered in the direction of rotation of the double-size drum 2) can enter the circumferential path of the double-size impression cylinder 1.

If roller blind strips 10.2 are used as illustrated in FIGS. 9 and 10, the clearances 26 required at the sheet end for the gripper devices 4 and 5 are provided by slots formed in the barrel 20 of the impression cylinder 1.

Figure 8:
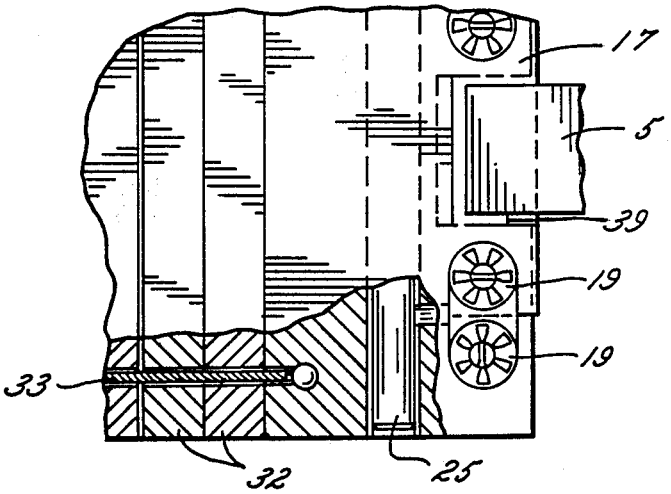
FIG. 8 is a plan view of another detail in partial section.

The end member 12 of the roller blind 10.1 including the foil cover 17 is also formed with recesses 39 for the gripper devices 4 and 5 of a row for gripping of the end of the sheet 13, said recesses 39 extending in line in the axial direction of the impression cylinder 1 (FIG. 8).

Figure 6:
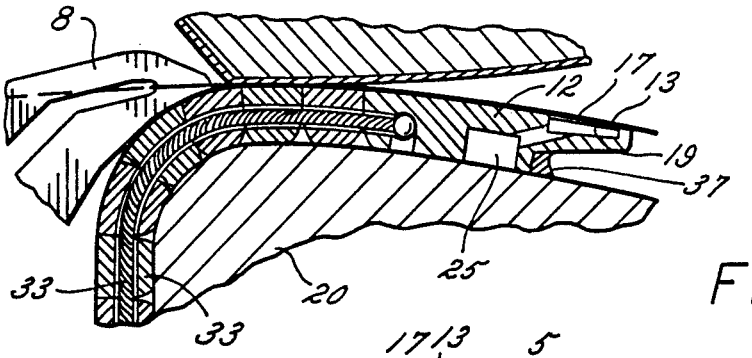
FIG. 6 is a cross-section showing a detail of the gripping of the sheet end at the impression cylinder by means of a gripper device.
Figure 11:
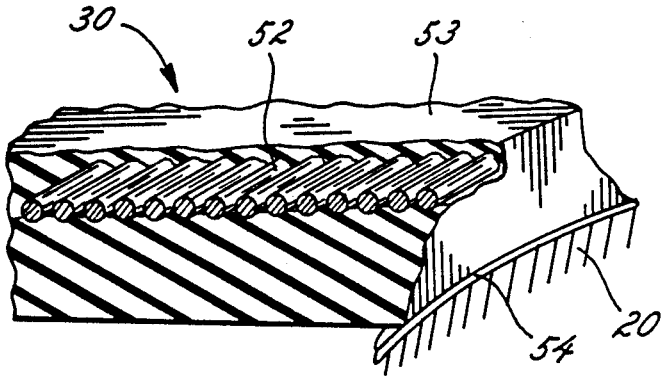
FIG. 11 is a diagram showing a hard blanket in the form of a composite material.

In keeping with the invention, the roller blind 10.1 comprises a covering 10 extending over the entire width and consisting of narrow strips 32 (FIG. 6) and/or chain links, wire fabric, a special rubber blanket or similar elastic bond 30 (FIG. 11), the covering having a substantially closed outer surface at the outside diameter of the impression cylinder, being radially rigid, and adapted to be wound up circumferentially. The narrow strips 32 in FIGS. 6 and 8 are strung on to a plurality of steel cords 33 and on the impression cylinder 1 have a substantially continuous surface. A suitable special rubber blanket, as illustrated in FIG. 11, for example, is a hard rubber blanket having a top layer 53 with inserts 52 and a base layer 54 with notches such that the bond is radially rigid and adapted to be wound up circumferentially on the impression cylinder 1. Wire fabric or similar elastic bonds 30 of other kinds must have comparable properties.

During operation of the press, both the roller blind 10.1 and the foil covering 17 or the top plate 31 above the roller blind strips 10.2 are adapted to be wound on shafts 16 and 18 mounted in the impression cylinder 1, depending upon the sheet length to which the system is set. Roughened surfaces 55 secure the position of the roller blind strips 10.2 on the shafts 18. The shafts 16, 18 are received in end walls 15 of the barrel 20.

Figure 3:
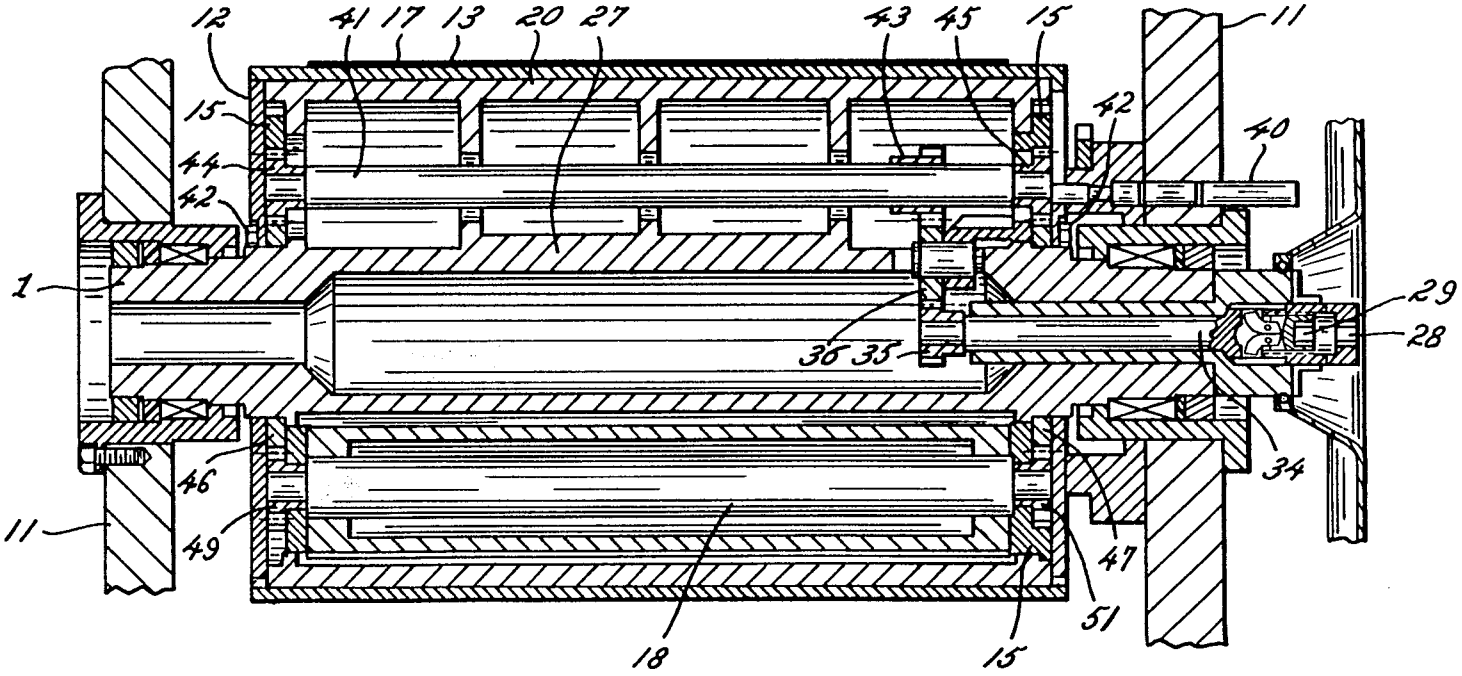
FIG. 3 is a longitudinal section through the impression cylinder.

An end element 12 of the roller blind 10.1 in FIG. 3 or the top plate 31 disposed above the roller blind strips 10.2 in FIG. 9 have a greater width at the end, are mounted at the end faces on a journal 27 of the impression cylinder 1 and are adjustable and lockable from the exterior by means 28 and 29.

Figure 4:
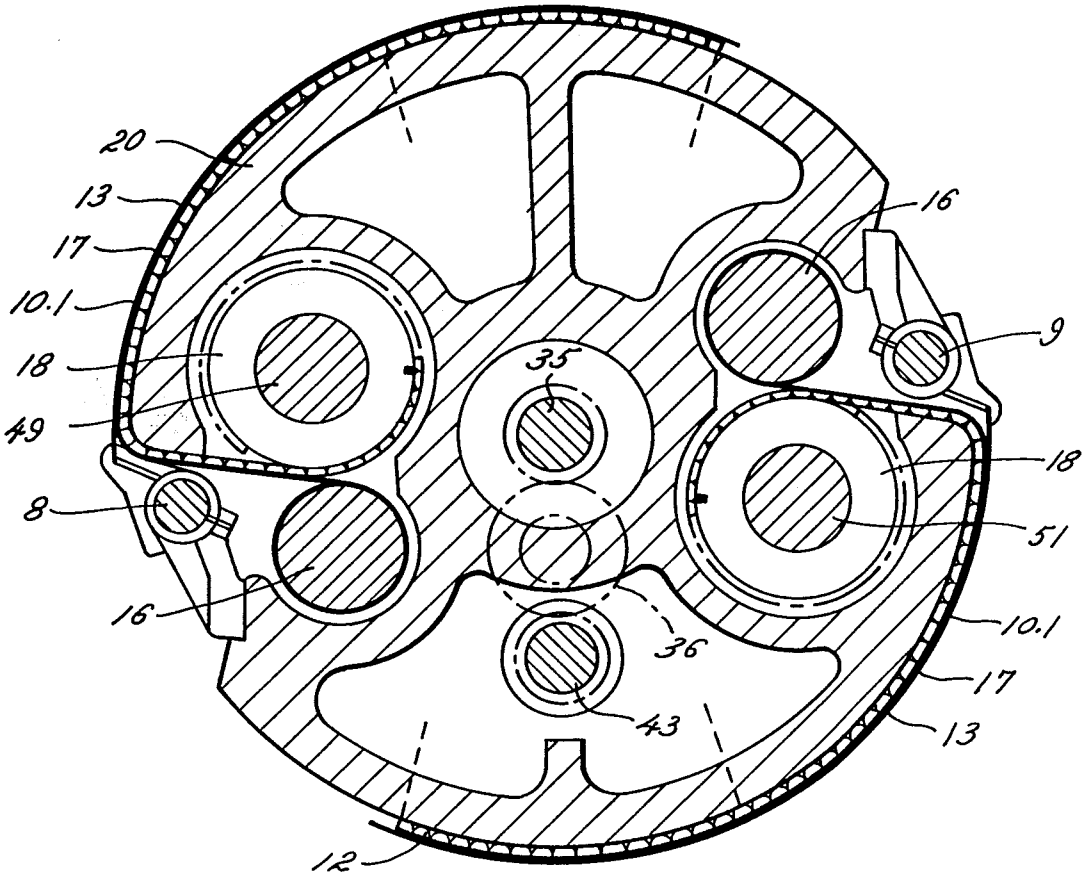
FIG. 4 is a cross-section through the impression cylinder.
Figure 5:
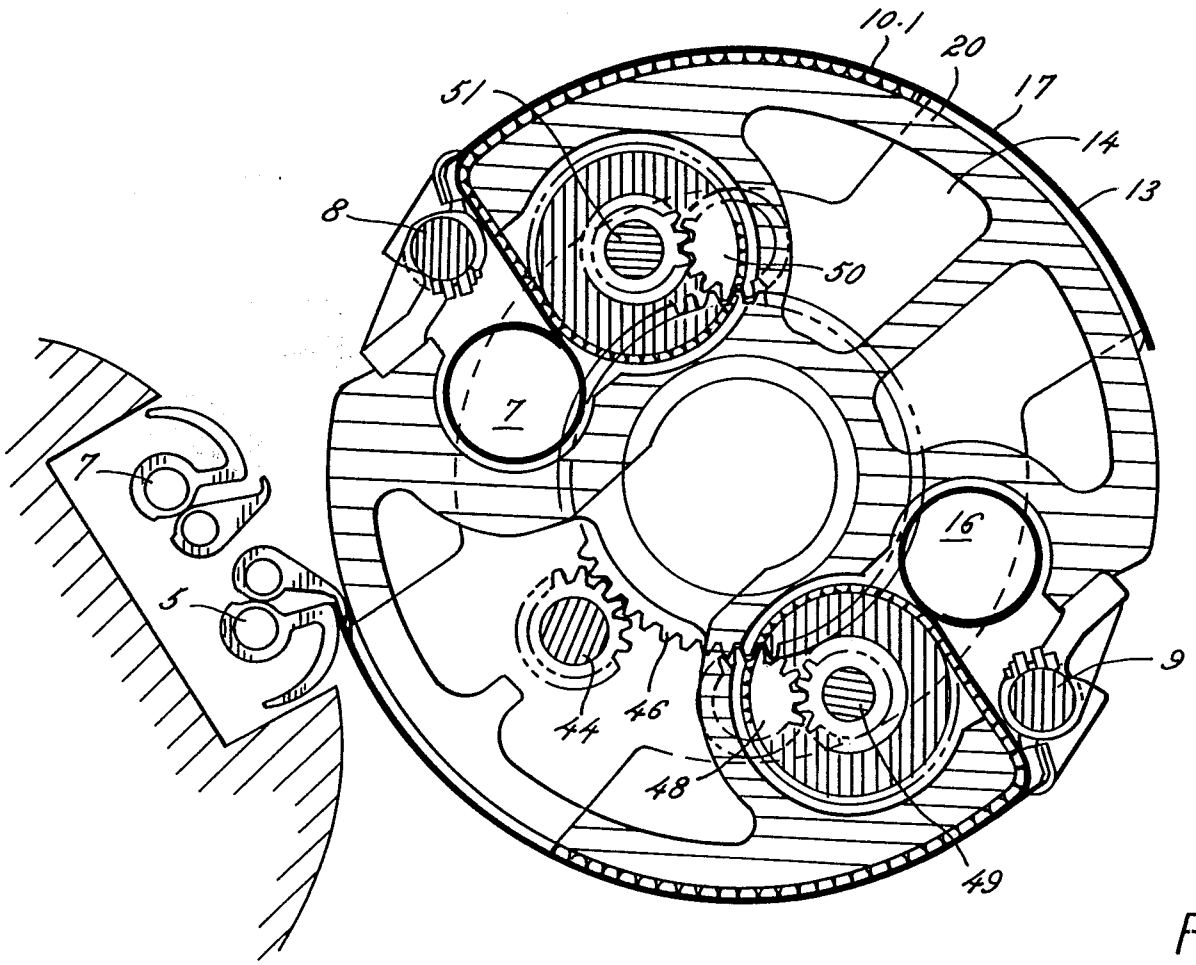
FIG. 5 is another cross-section through the impression cylinder.

To permit format adjustment in FIGS. 3 and 9, axially consecutive internal hexagonals of the same size and associated internal hexagonal keys enable a device 29 to be released from its clamping position so that the covering 10 can be circumferentially displaced on the barrel 20 of the leading impression cylinder 1. The device 28 required for this purpose comprises an adjusting shaft 34 integrated in the journals 27 of the impression cylinder 1. An adjusting pinion 35 is secured on the adjusting shaft 34 and is operatively connected to another adjusting pinion 43 via a gearwheel 36 mounted in the impression cylinder 1, the pinion 43 being secured on an adjusting shaft 41 mounted in the end walls 15 (FIGS. 3, 4 and 9). Other adjusting pinions 44, 45 at the two ends of the shaft 41 drive crown wheels 46, 47 which are mounted on the journal 27 in the end walls 15 and which are in turn operatively connected by other pinions 48, 49 and 50, 51 to two wind-up shafts 18 and, via bolts 42, to the side parts 14 of the end element 12 of the roller shutter 10.1 or the end of the cover plate 31 (FIGS. 3, 5 and 9).

Referring to FIGS. 6–8, to ensure that the trailing edge of the sheet 13 is tautened, adjustable suction cups 19 extending in line in the axial direction of the impression cylinder 1 are incorporated in the end element 12 of the roller blind 10.1 and receive suction air via a duct 25. Similarly, FIGS. 9 and 10 illustrate suction surfaces incorporated in the roller blind strips 10.2 at the end thereof and receive suction air via a suction device 22, extending in a line in the axial direction of the impression cylinder 1. The outer suction cups 19 can be closed if the sheet format is narrower than the covering 10, i.e., the sheet transport surface. The suction device 22 in FIGS. 9 and 10 is in known manner in the form of a rake corresponding to the pitch of the roller blind strips 10.2 in the barrel 20 of the leading impression cylinder 1 and is flush with the surface of the top plate 31 with suction surfaces and suction bores (not shown). A suction air supply 40 is provided to pass the suction air to the suction device 22 and from it the suction air is fed to the interior of the barrel 20. The suction air supply 40 is connected to the side parts 14 of the continuous cover plate 31 pivotable on the barrel 20 of the impression cylinder 1 and, as will be seen in FIG. 10, can slide circularly in a slot 38 in the end walls 15 on a change of format.

To ensure that the matching printing surface is always smooth, the roller blind 10.1 or roller blind strips 10.2 are ground on the impression cylinder 1. Also, connecting elements and spring elements (not shown) connect the roller blind 10.1 to the foil covering 17 or the roller blind strips 10.2 to the cover plate 31 in a known manner preferably at the end of the covering 10 and the latter can additionally be tensioned, e.g., by torsion springs, at the wind-up shafts 16, 18. This ensures that the covering 10 guided relatively loosely on the barrel 20 of the impression cylinder 1 is always in a secure position. A stripper 37 shown in FIGS. 6 and 7 clears any deposits from the barrel 20.

With the arrangement of the impression cylinders 1, 3 transfer or turn-over drum 2 and associated gripper systems as illustrated, it is possible both to print the sheet 13 on one side in two colors, and to turn the sheet 13 over in functional association with the leading impression cylinder 1 thus enabling the sheet 13 to be printed on both sides. The second printing unit is then used as a perfector unit.

When only one side of the sheet is printed, the sheet 13 is transported in known manner, for example by transfer from the gripper devices 9 of the impression cylinder 1 to the gripper devices 6 of the transfer drum 2 and from the latter to the gripper devices 24 of the impression cylinder 3, so that this is not described in detail (see FIG. 1).

Figure 12:
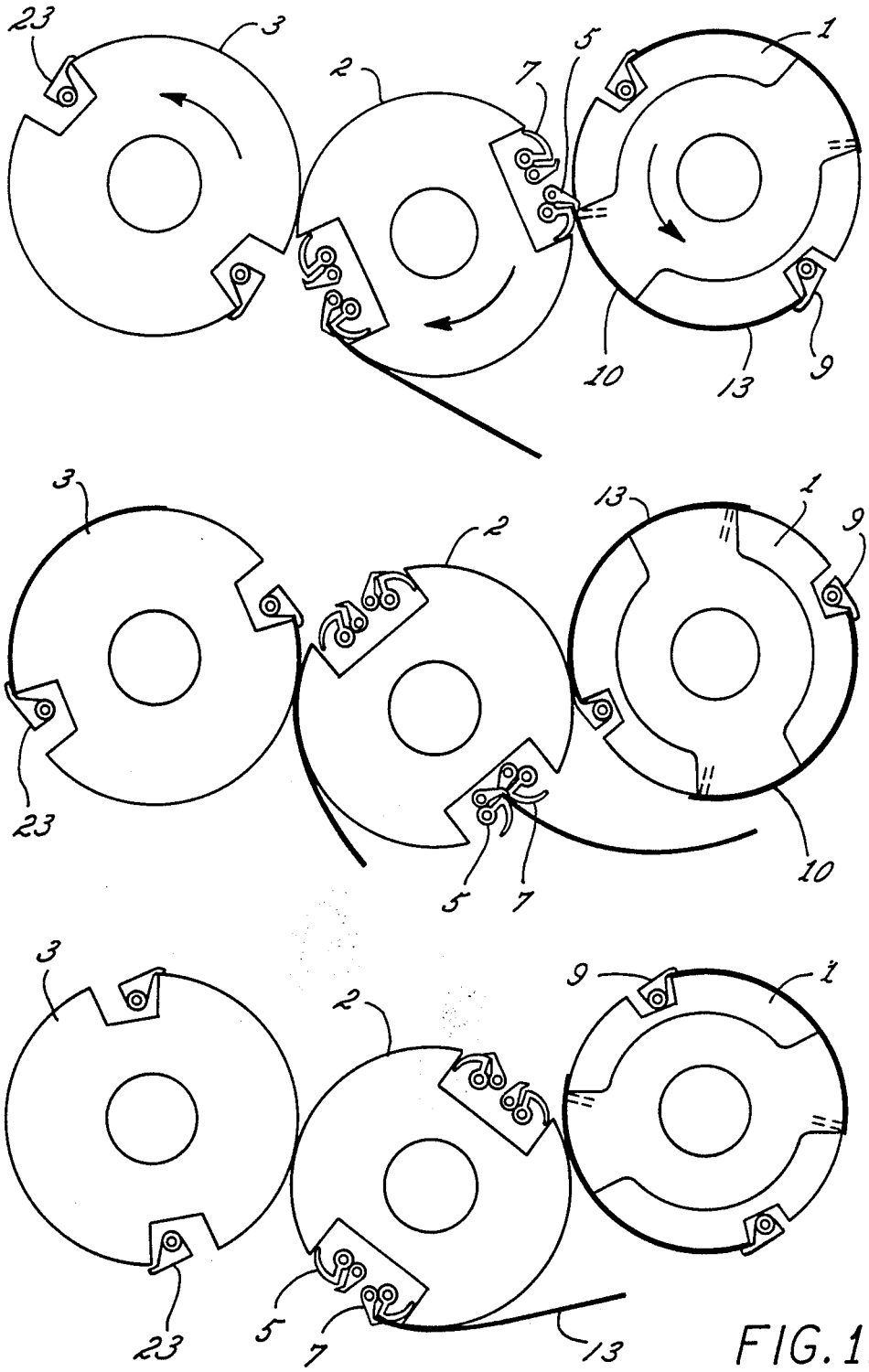
FIG. 12 shows the turning-over operation in three phases.

In printing both sides of the sheet 13 as shown in three phases in FIG. 12, the sheet 13 has been passed, for example, by the gripper devices 9 of the leading impression cylinder 1 over the tangent point in a first phase and the sheet end has reached the tangent point.

The sheet end is engaged by the gripper devices 5, and then the gripper devices 9 release the sheet.

In keeping with the invention, by adjusting the covering 10 to the sheet end, unobstructed engagement beneath the sheet end at the leading impression cylinder 1 is possible by means of mechanical gripper systems. In a second phase, the gripper devices 5 and the gripper devices 7 are pivoted in known manner towards the center of the turn-over drum 2 and towards one another during further rotation of the impression cylinders 1, 3 and of the turn-over drum 2. In these conditions, the sheet 13 is transferred at the sheet end from the gripper devices 5 to the gripper devices 7 and the latter in another phase convey the sheet to the printing line while the gripper devices 7 simultaneously swing out. The sheet 13 has now been turned over in register, without any smearing or creasing and is transferred by the gripper devices 7 with the trailing edge at the front to the gripper devices 23 of the impression cylinder 3. The next sheets are transferred in the same way, the impression cylinders 1, 3 and the turnover drum 2 being arranged to transport two sheets in each case at the periphery as will be seen from the drawing.

I claim as my invention:

1. An assembly in a rotary press for turning a sheet comprising in combination:

a first impression cylinder for retaining said sheet as said sheet is printed on a first side;

a second impression cylinder for retaining said sheet as said sheet is printed on a second side;

a rotating transfer drum positioned between said first and second impression cylinders for removing said sheet from said first impression cylinder and delivering said sheet to said second impression cylinder;

means for providing a circumferential adjustable covering about the surface of said first impression cylinder which serves as a support surface for said sheet and extends circumferentially about said first impression cylinder a distance that is less than the circumferential extent of said sheet about said first impression cylinder such that a trailing end of said sheet extends beyond an end of said covering; and said transfer drum including a gripper system for gripping said trailing end of said sheet.

2. An assembly according to claim 1 wherein said covering comprises a plurality of roller blind strips accommodated in said first impression cylinder in countersunk relationship in the circumferential direction, the surfaces of said plurality of roller blind strips coinciding with the surface of said first impression cylinder and being covered by a continuous cover to give said first impression cylinder its actual diameter.

3. An assembly according to claim 2 wherein said roller blind strips collectively form a radially rigid continuous outer surface extending partially about the outside diameter of said first impression cylinder, and a shaft recessed into said first impression cylinder for winding said roller blind strips in a circumferential direction.

4. An assembly according to claim 2 wherein said roller blind strips are strung on a plurality of steel cords to form a substantially continuous surface on said first impression cylinder.

5. An assembly according to claim 3 wherein one circumferential extent of said covering includes an end element mounted to a journal of said first impression cylinder and said end element is responsive to a clamping device for extending or retracting the circumferential extent of said covering over the surface of said first impression cylinder.

6. An assembly according to claim 4 wherein one circumferential extent of said covering includes an end element mounted to a journal of said first impression cylinder and said end element is responsive to a clamping device for extending or retracting the circumferential extent of said covering over the surface of said first impression cylinder.

7. An assembly according to claim 2 wherein one circumferential extent of said continuous cover includes an end element which is mounted to a journal of said first impression cylinder and said end element is responsive to a clamping device for extending or retracting the circumferential extent of said roller blind strips and said continuous cover over the surface of said first impression cylinder.

8. An assembly according to claim 2 wherein suction cups extending in a line in the axial direction of said first impression cylinder are incorporated in an end element of said roller blind strips and receive suction air via a duct.

9. An assembly according to claim 3 wherein suction cups extending in a line in the axial direction of said first impression cylinder are incorporated in an end element of said roller blind strips and receive suction air via a duct.

10. An assembly according to claim 4 wherein suction cups extending in a line in the axial direction of said first impression cylinder are incorporated in an end element of said roller blind strips and receive suction air via a duct.

11. An assembly according to claim 7 wherein suction cups extending in a line in the axial direction of said first impression cylinder are incorporated in an end element of said roller blind strips and receive suction air via a duct.

12. An assembly according to claim 2 wherein suction surfaces extending in a line in the axial direction of said first impression cylinder are incorporated in said roller blind strips at the end thereof and are supplied with suction air by a suction device.

13. An assembly according to claim 7 wherein suction surfaces extending in a line the axial direction of said first impression cylinder are incorporated in said roller blind strips at the end thereof and are supplied with suction air by a suction device.

14. An assembly according to claim 6 wherein recesses for receiving gripper devices of said gripper system are provided in said end element, said recesses extending in a line in the axial direction of said first impression cylinder.

15. An assembly according to claim 7 wherein recesses for receiving gripper devices of said gripper system are provided at the end of said continuous cover for allowing said gripper devices to grip the end of said sheet, said recesses extending in a line in the axial direction of said first impression cylinder.

16. An assembly according to claim 12 wherein recesses for receiving gripper devices of said gripper system are provided at the end of said continuous cover for allowing said gripper devices to grip the end of said sheet, said recesses extending a line in the axial direction of said first impression cylinder.

17. An assembly according to claim 1 wherein said first impression cylinder is barrel-shaped and has a circumferentially continuous surface on which rests said covering, said covering providing the actual printing surface.

18. An assembly according to claim 17 wherein said means includes a shaft mounted in said first impression cylinder and secured to one end of said covering for rolling or unrolling said covering about said shaft, thereby adjusting the circumferential extent of said covering about said first impression cylinder.

* * * * *